US005687440A

United States Patent [19]

Min et al.

[11] Patent Number: 5,687,440

[45] Date of Patent: Nov. 18, 1997

[54] WASHING METHOD CAPABLE OF PREVENTING THE FORMATION OF SUDS IN A WASHING MACHINE

[75] Inventors: Tae-Sik Min, Seoul; Seung-Jun Lee; Chung-Sik Jung, both of Inchon, all of Rep. of Korea

[73] Assignee: Daewoo Electronics Co., Ltd, Seoul, Rep. of Korea

[21] Appl. No.: 558,889

[22] Filed: Nov. 16, 1995

[30] Foreign Application Priority Data

Apr. 29, 1995 [KR] Rep. of Korea ..... 95-10388
Apr. 29, 1995 [KR] Rep. of Korea ..... 95-10398

[51] Int. Cl.[6] ..... D06F 39/08

[52] U.S. Cl. ..... 8/158; 8/159; 68/12.05

[58] Field of Search ..... 8/159, 158; 68/12.05, 68/12.19, 12.21, 207

[56] References Cited

U.S. PATENT DOCUMENTS

| | | | |
|---|---|---|---|
| 4,580,421 | 4/1986 | Babuin et al. | 68/12.19 |
| 4,835,991 | 6/1989 | Knoop et al. | 68/12.19 |
| 5,167,722 | 12/1992 | Pastryk et al. | 68/12.05 |
| 5,199,127 | 4/1993 | Newenhizen et al. | 8/159 |
| 5,297,307 | 3/1994 | Baek | 8/159 |
| 5,439,019 | 8/1995 | Quande et al. | 68/12.05 |
| 5,515,515 | 5/1996 | Maddix et al. | 68/12.05 |

FOREIGN PATENT DOCUMENTS

| | | | |
|---|---|---|---|
| 59-149192 | 8/1984 | Japan | 68/12.19 |

*Primary Examiner*—Frankie L. Stinson
*Attorney, Agent, or Firm*—Beveridge, DeGrandi, Weilacher & Young, LL

[57] ABSTRACT

Disclosed is a washing method which can eliminate suds or foam created in the course of washing by a washing machine and can effectively prevent the creation of foam, thereby improving the washing efficiency of the washing machine. In the washing method, a part of the washing liquid is continuously recirculated and sprayed during the washing process while the washing liquid is partially drained at each predetermined time interval. In the rinsing process, a part of the rinsing water is also continuously recirculated and sprayed during the rinsing process while the rinsing water is partially drained at each predetermined time interval.

20 Claims, 6 Drawing Sheets

WASHING METHOD CAPABLE OF PREVENTING THE FORMATION OF SUDS IN A WASHING MACHINE

BACKGROUND OF THE INVENTION

1. Field of the Invention

The present invention relates to a washing method, and more particularly to a washing method capable of removing suds or foam which may form in a washing machine in the course of washing articles to be washed by the washing machine.

2. Prior Arts

In a general washing method by a washing machine, washing liquid and cleaning additives such as detergents are supplied into a washing tub of the washing machine, and articles to be washed are immersed into the washing liquid along with the additives. Then, the washing tub or a pulsator in the washing tub rotates at a high speed, so as to agitate the articles to be washed in the washing liquid. In this case, the washing tub or the pulsator does not rotate until the washing liquid reaches a predetermined height in the washing tub, but rotates as soon as the washing liquid reaches the predetermined height.

Meanwhile, cleaning additives such as detergent generally have a component of surfactant. The surfactant produces suds or foam while the articles to be washed are agitated in the washing liquid by the pulsator as described above. Such suds or foam produced during the washing process weaken the washing force of the detergent, and thereby deteriorate the washing effect of the washing machine.

Further, in a single-tub type washing machine having a container and a spin tub rotatably mounted in the container, the spin tub has a peripheral wall in which a plurality of pores are defined, and some of the foam created during the washing process leaks out of the spin tub through the pores into the gap between the spin tub and the container. The foam in the gap between the spin tub and the container disturbs the rotation of the spin tub due to its surface tension, thereby lowering the operational efficiency of the washing machine and having a bad effect on the life of the driving motor in the washing machine.

Furthermore, when the spin rotates at a very high speed in the dehydration process by the washing machine, the foam elevates along the gap between the spin tub and the container due to the centrifugal force applied thereto by the high-speed rotation of the spin tub and may be located at a very high position of the gap. Therefore, it is not easy to clean the foam so that a large amount of water is required to clean the foam.

U.S. Pat. No. 4,631,771 issued to Anderson et al. discloses a clothes washing machine and a washing method to overcome the above-described disadvantage caused by the foam in the conventional washing machine. Anderson's washing method includes the step of slowly or gently rotating the spin tub or slowly or gently agitating clothes in the container during the time when the hot water valve is opened.

Anderson's washing method further includes the steps of causing the spin tub to commence a spinning phase of the clothes washing cycle, accelerating the spin tub and its contents through the critical speed (lateral resonance speed) to a holding speed not greatly above that critical speed, and holding the speed at that holding speed for a sufficient length of time as to prevent or substantially reduce the creation of suds or foam caused by cleaning additives such as detergents in the washing liquid until conditions for suds forming have been substantially eliminated.

However, in Anderson's washing method, the rotational speed of the spin tub is limited, and thereby the intensity of the agitation of the clothes is limited. Accordingly, it is problematic in that Anderson's washing method prolongs the washing time and deteriorates the washing effect.

SUMMARY OF THE INVENTION

The present invention has been made to overcome the above described problems of the prior arts, and accordingly it is an object of the present invention to provide a washing method which can eliminate suds or foam created in the course of washing by a washing machine and can effectively prevent the creation of foam without limiting to the rotational speed of a spin tub of the washing machine, so as to improve the washing efficiency of the washing machine.

To achieve the above object, the present invention provides a washing method by a washing machine having a spin tub for accommodating articles to be washed and a container for mounting the spin tub in the container, the spin tub having means for interconnecting a space in the container and a gap between the spin tub and the container, the washing method comprising the steps of:

(1) introducing a first amount of a washing liquid into the spin tub until the height of the washing liquid in the container reaches a first height;

(2) recirculating a first portion of the washing liquid in the container, and spraying the first portion of the washing liquid into the spin tub, while introducing a second amount of the washing liquid into the spin tub until the height of the washing liquid reaches a second height;

(3) washing the articles in the spin tub during a first period;

(4) draining a predetermined amount of the washing liquid in the container out of the washing machine;

(5) recirculating a second portion of the washing liquid remaining in the container, and spraying the second portion of the washing liquid into the spin tub, while washing the articles during a second period; and (6) repeating steps 4 and 5 at least once.

According to the first aspect of the present invention, the articles are washed in the spin tub in step 2. In step 3, the first portion of the washing liquid is recirculated and sprayed into the spin tub while the articles in the spin tub are washed. In step 4, the articles are washed in the spin tub while the predetermined amount of the washing liquid in the container is drained out of the washing machine. The predetermined amount of the washing liquid may be one-third of a quantity of the washing liquid in the container when the height of the washing liquid is the second height, and steps 4 and 5 are repeated three times in step 6.

According to the second aspect of the present invention, the washing method further includes a rinsing process similar to the washing process according to the first embodiment after step 6.

In the washing method of the present invention as described above, a part of the washing liquid is continuously recirculated and sprayed during the washing process while the washing liquid is partially drained at every predetermined time interval. Through the above recirculation and spray of the washing liquid with the divisional drainage thereof, the washing method of the present invention eliminates the foam that has formed during the washing process and prevents the formation of new foam.

Further, according to the second embodiment of the present invention, a part of the rinsing water is also continuously recirculated and sprayed during the rinsing process while the rinsing water is partially drained at each predetermined time interval. Through the above recirculation and spray of the rinsing water with the divisional drainage thereof in the rinsing process, the washing method of the present invention further eliminates the foam that has formed during the rinsing process and prevents the formation of new foam.

BRIEF DESCRIPTION OF THE DRAWINGS

The above object, and other features and advantages of the present invention will become more apparent by describing in detail preferred embodiments thereof with reference to the attached drawings, in which.

DESCRIPTION OF THE PREFERRED EMBODIMENTS

Hereinafter, several preferred embodiments of the present invention will be described in detail with reference to the accompanying drawings.

Figure 1:
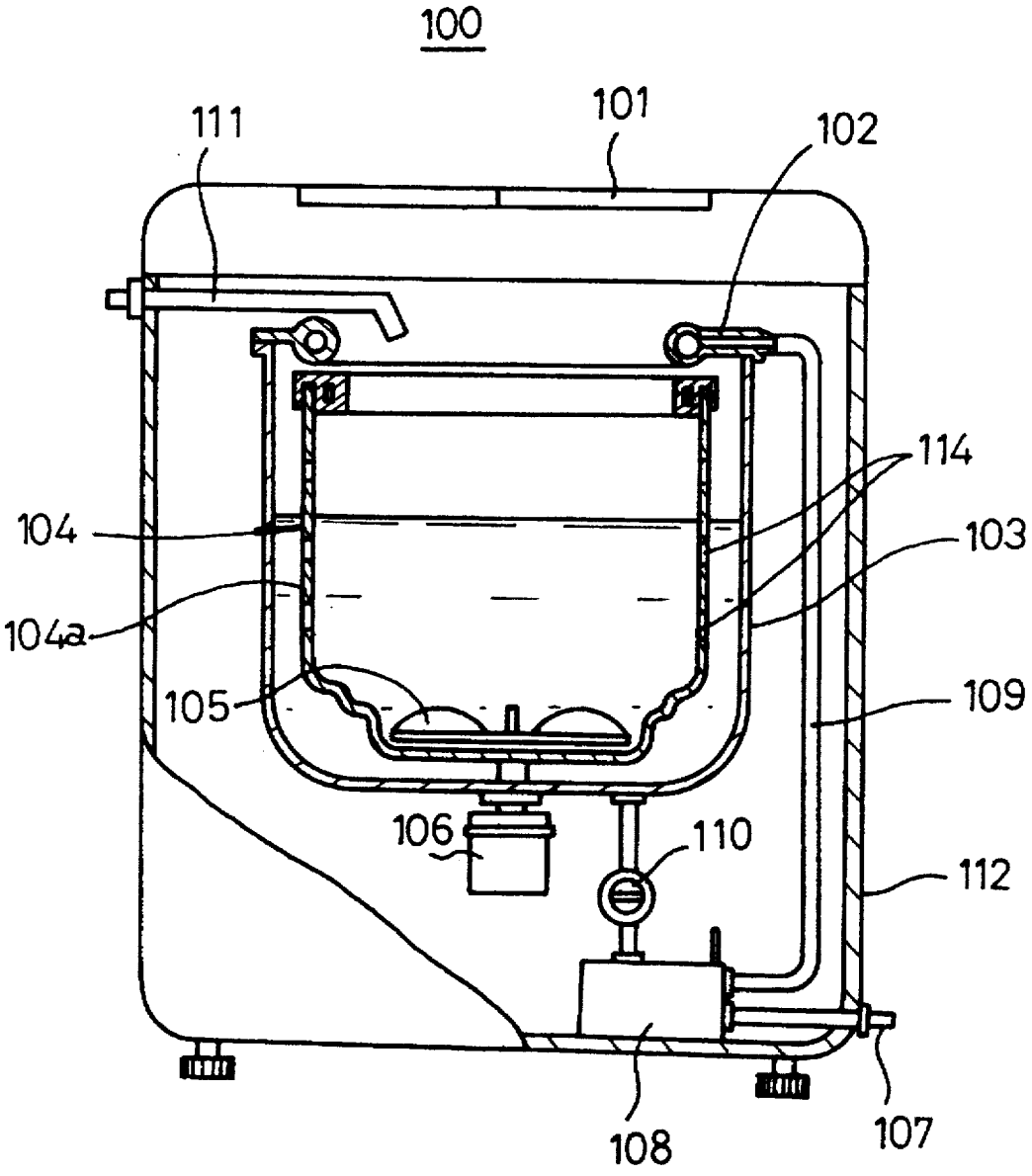
FIG. 1 is a schematic sectional view of a washing machine by which a washing method of the present invention can be performed.

FIG. 1 is a schematic sectional view of a washing machine 100 by which a washing method of the present invention can be performed.

Washing machine 100 has a housing 112, a container 103 in housing 112, and a spin tub 104 in container 103. Spin tub 104 has a pulsator 105 mounted on the middle of the bottom thereof. A motor 106 for driving pulsator 105 is disposed under container 103. A water-supply pipe 111 is installed above container 103 and spin tub 104. A valve 110 is disposed under and connected to container 103. A pump 108 is connected to valve 110.

Spin tub 104 has a peripheral wall 104*a* provided with a plurality of pores 114. The space in spin tub 104 is interconnected to the gap between container 103 and spin tub 104.

A drain pipe 107 extends from pump 108 through housing 112 out of washing machine 100. A spray nozzle 102 is disposed above container 103. Spray nozzle 102 and pump 108 are interconnected with each other thorough a recirculation pipe 109. Meanwhile, reference numeral 101 (not described above) designates a door disposed at the top of washing machine 100.

Figure 2:
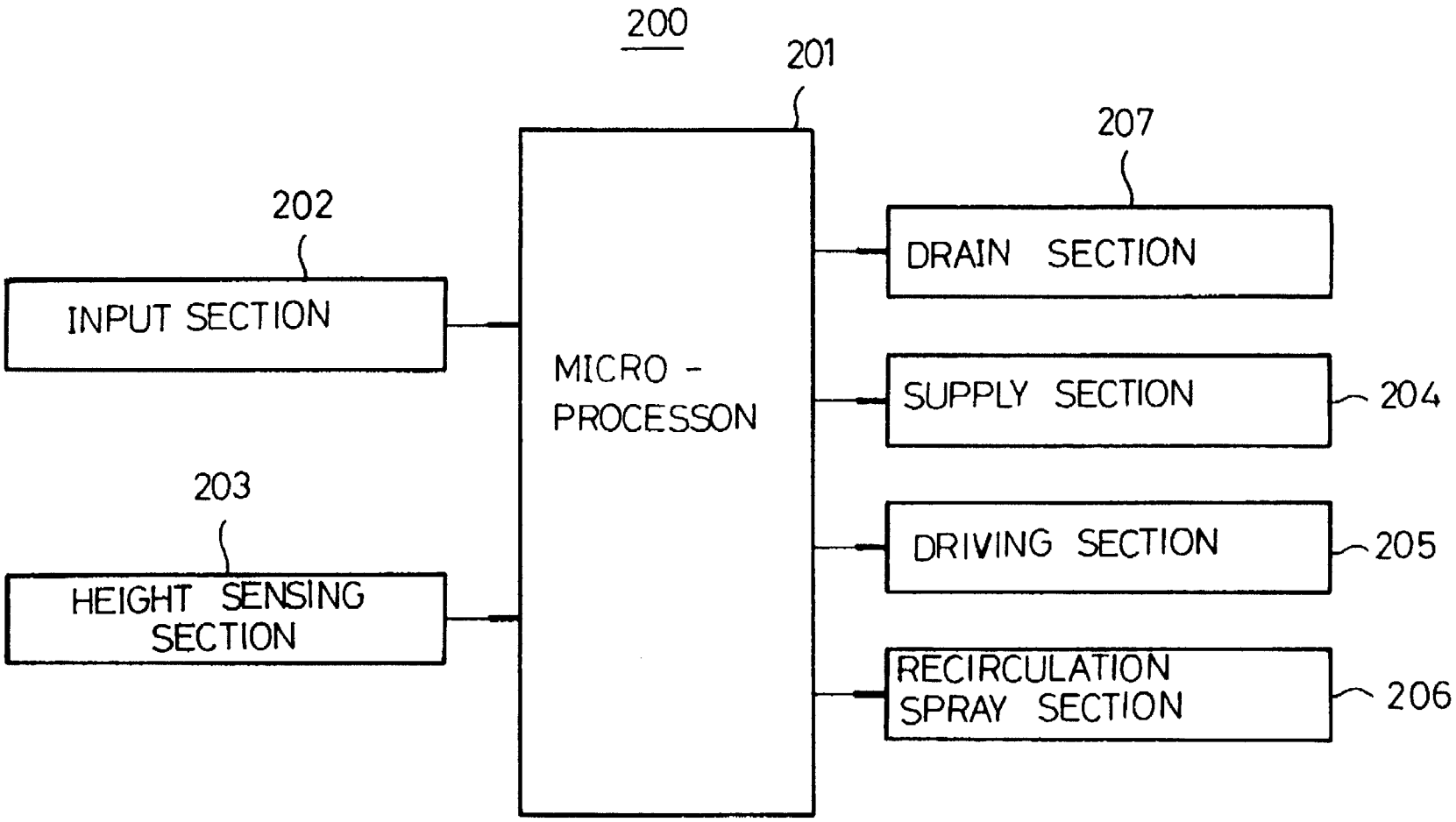
FIG. 2 is a block diagram for showing the schematic construction of a control section of the washing machine shown in FIG. 1.

FIG. 2 is a block diagram of a control section 200 of washing machine 100. As shown, control section 200 has a microprocessor 201, a control signal input section 202, a height-sensing section 203, a supply section 204, a driving section 205, a recirculation section 206, and a drain section 207.

Embodiment 1

Figure 3A:
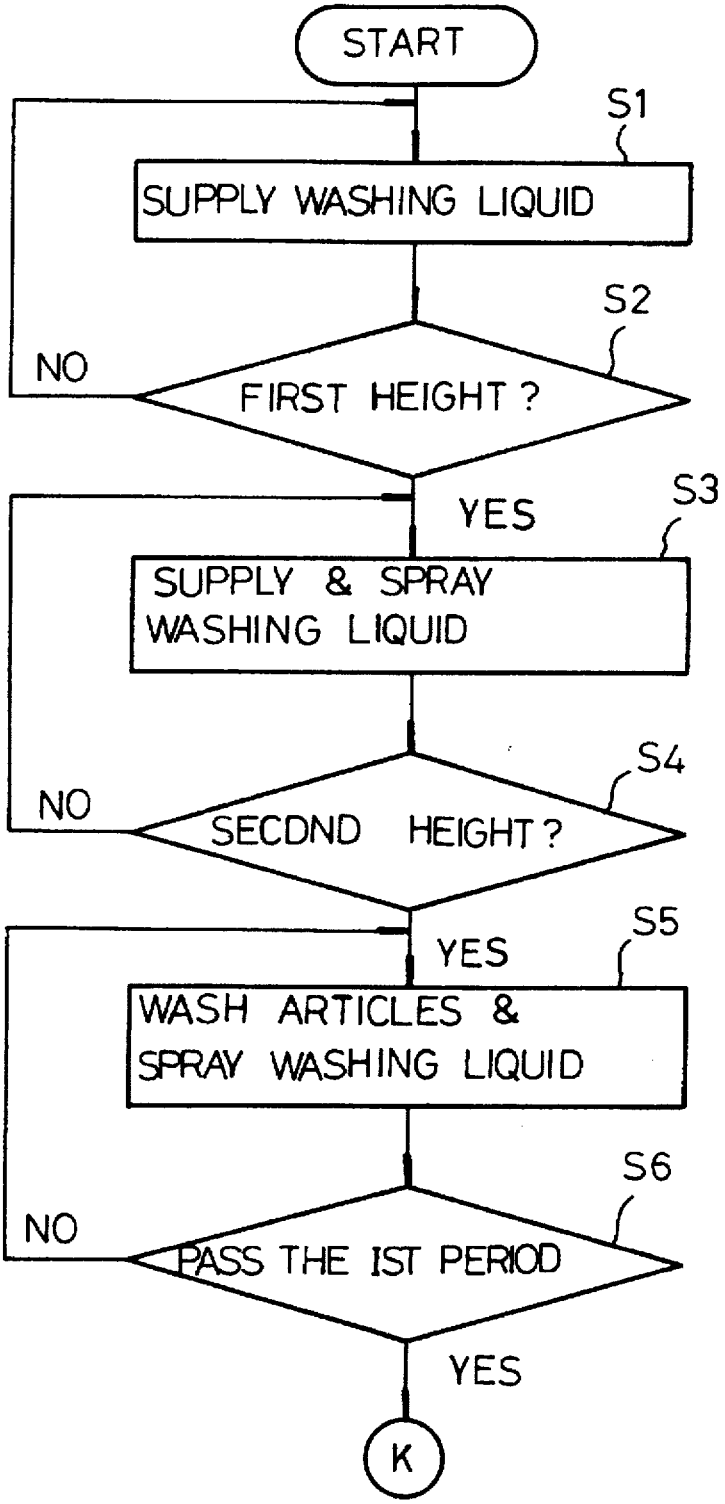
FIGS. 3A and 3B are a flow chart of a washing process according to the first embodiment of the present invention.
Figure 3B:
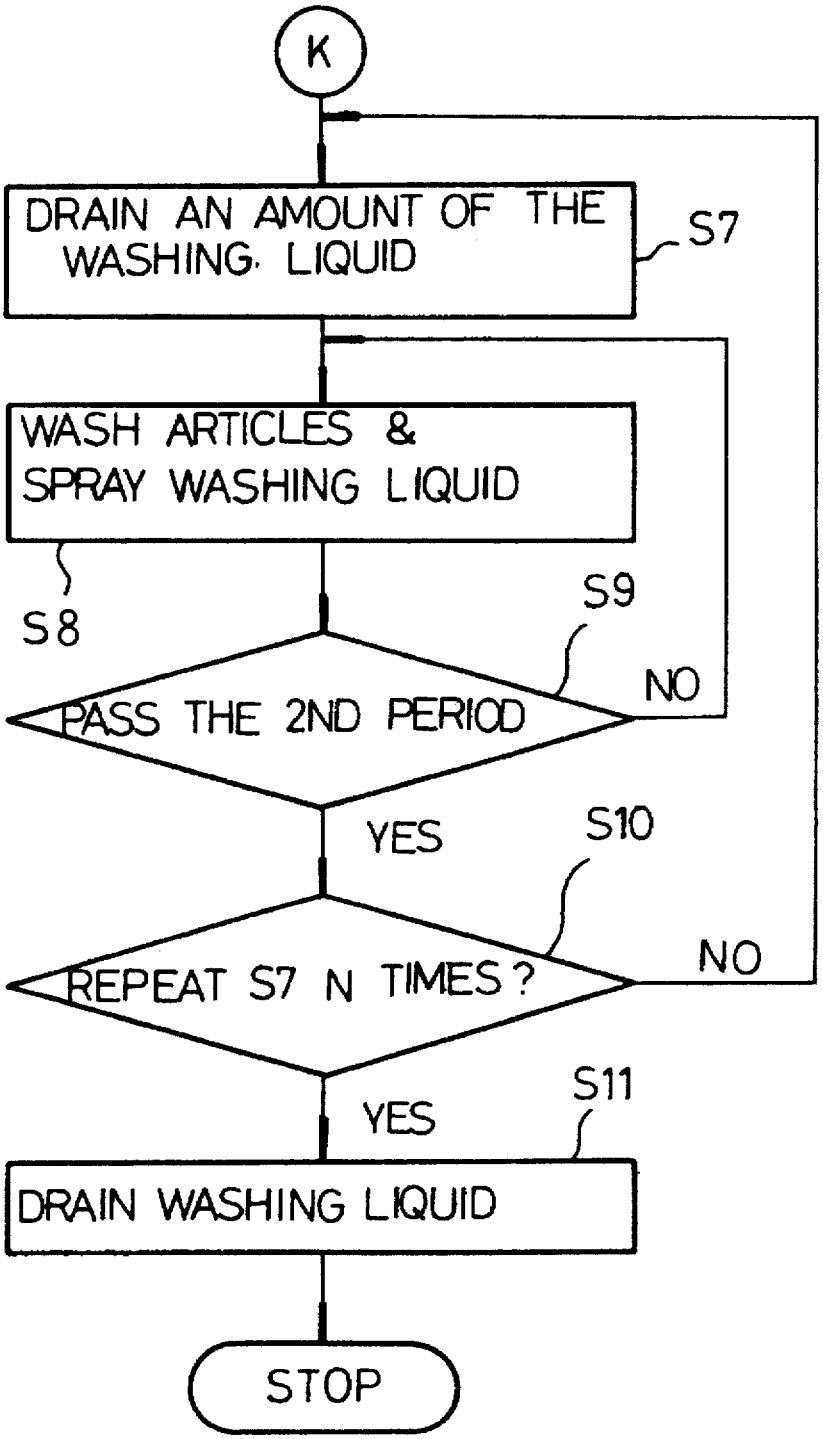

FIGS. 3A and 3B are a flow chart of a washing process in a washing method by washing machine 100 having the above-described construction according to the first embodiment of the present invention.

In the washing process, washing liquid is introduced through water-supply pipe 111 into spin tub 104 by the operation of supply section 204 according to a signal from control signal input section 204 (step S1). In this case, detergent may be dissolved in the introduced washing liquid, otherwise it may be separately supplied into spin tub 104 simultaneously with or after the supply of the washing liquid. The washing liquid once introduced in spin tub 104 is also introduced into container 103, because the space in spin tub 104 is interconnected to the gap between container 103 and spin tub 104 through pores 114.

The washing liquid continues to be supplied into spin tub 104 until its height reaches the predetermined first height in container 103. During the supply of the washing liquid, height-sensing section 203 senses the height of the washing liquid and sends it to microprocessor 201 as data. Microprocessor 201 compares the first height and the data with each other and determines if the height of the washing liquid in spin tub 104 and container 103 reaches the first height (step S2).

When the height of washing liquid reaches the first height, microprocessor 201 initiates the operation of recirculation-supply section 206. According to the operation of recirculation-supply section 206, valve 110 is opened, and pump 108 pumps out a part of the washing liquid in container 103 and spin tub 104 and supplies to spray nozzle 102 through recirculation pipe 109. The pumped washing liquid is sprayed through spray nozzle 102 into spin tub 104 (step S3). That is, a part of the washing liquid in container 103 is recirculated and sprayed while the supply of the washing liquid into spin tub 104 is continued when the height of the washing liquid reaches the first height. In this case, such recirculation and spray of the washing liquid as above facilitates dissolution of the detergent in the washing liquid, and thereby shortens the entire washing time of the washing machine.

Meanwhile, washing liquid continues to be introduced and sprayed into spin tub 104 even after the height of the washing liquid reaches the first height. Height-sensing section 203 continues to sense the height of the washing liquid, and microprocessor 201 determines on the basis of data from height-sensing section 203 if the height of the washing liquid reaches the second height (step S4). In this case, the second height is preset in microprocessor 201 through control signal input section 202 according to the washing conditions such as the kind of washing loads, desired washing time, and the washing intensity required by the user.

When the height of the washing liquid reaches the second height, microprocessor 201 stops the operation of supply section 204 and initiates the operation of driving section 205 so as to rotate pulsator 106 (step S5). Accordingly, the supply of the washing liquid is stopped, and the washing liquid in spin tub 104 is agitated by the rotation of pulsator 105, and thereby the washing load in the spin tub 104 is washed. Even while pulsator 105 rotates, the operation of recirculation-spray section 206 continues so that the washing liquid continues to be sprayed through spray nozzle 102 into spin tub 104. At that time, the spray of the washing liquid facilitates dissolution of the detergent in the washing liquid as described above, and improves the washing effect of the washing machine.

While the rotation of pulsator 105 is initiated at the second height in the present embodiment, the rotation may be initiated at the first height or at a proper height between the first and the second heights so as to further facilitate the dissolution of detergent in the washing liquid according to other embodiments of the present invention.

The second height is higher than the first height, and the difference between the first and second heights can be optimized by properly determining the first height according to the washing condition.

After the rotation of pulsator 105 is started, microprocessor 201 determines if the first period has passed (step S6). The first period is preset in microprocessor 201 through control signal input section 202 by a user.

After the first period, microprocessor 201 stops the operation of driving section 205 and operates drain section 207 so as to drain a predetermined amount of washing liquid out of washing machine 100 (step S7). Meanwhile, the rotation of pulsator 105 by the operation of driving section 205 may continue while the washing liquid is drained, according to other embodiments of the present invention.

When the predetermined washing liquid has been drained in step S7, the height of the washing liquid is lowered, and foam having been generated due to the agitation of the washing liquid by the rotation of pulsator 105 gathers on the lowered top of the washing liquid and in the gap between container 103 and spin tub 104. As described above, this foam not only weakens the washing force of the washing liquid but also may disturb the rotation of spin tub 104 in a dehydrating process due to the surface tension of the foam.

After the predetermined amount of the washing liquid is drained, microprocessor 201 operates driving section 205 and recirculation-supply section 206 again so as to wash the washing load by rotating pulsator 105 and at the same time spray the washing liquid through the recirculation thereof (step S8). The above spray of the washing liquid removes the gathered foam and prevents the production of new foam or suds.

While the washing load is being washed and the washing liquid is being sprayed in step S8, microprocessor 201 determines if the second period has passed (step S9). The second period is preset in microprocessor 201 through control signal input section 202 by a user.

After the second period, microprocessor 201 determines if step S7 in which the predetermined amount of the washing liquid is drained has been performed a preset n times (step S10). N times is a value preset in microprocessor 201 through control signal input section 202 by a user.

When step S7 has not been performed n times, the process goes back to step S7 and is repeated again from step S7. When step S7 has been performed n times, the washing process ends.

In this case, microprocessor 201 is programmed to make drain section 207 drain the washing liquid out of the container 103 completely. However, according to other embodiments, the washing process may further include step S11 of draining the washing liquid out of the washing machine in order to ensure the drainage of the washing liquid from the washing machine. After the washing process, a rinsing process proceeds.

Embodiment 2

A washing method according to the second embodiment of the present invention includes a rinsing process further to the washing process according to the first embodiment. The rinsing process is similar to the washing process.

Figure 4A:
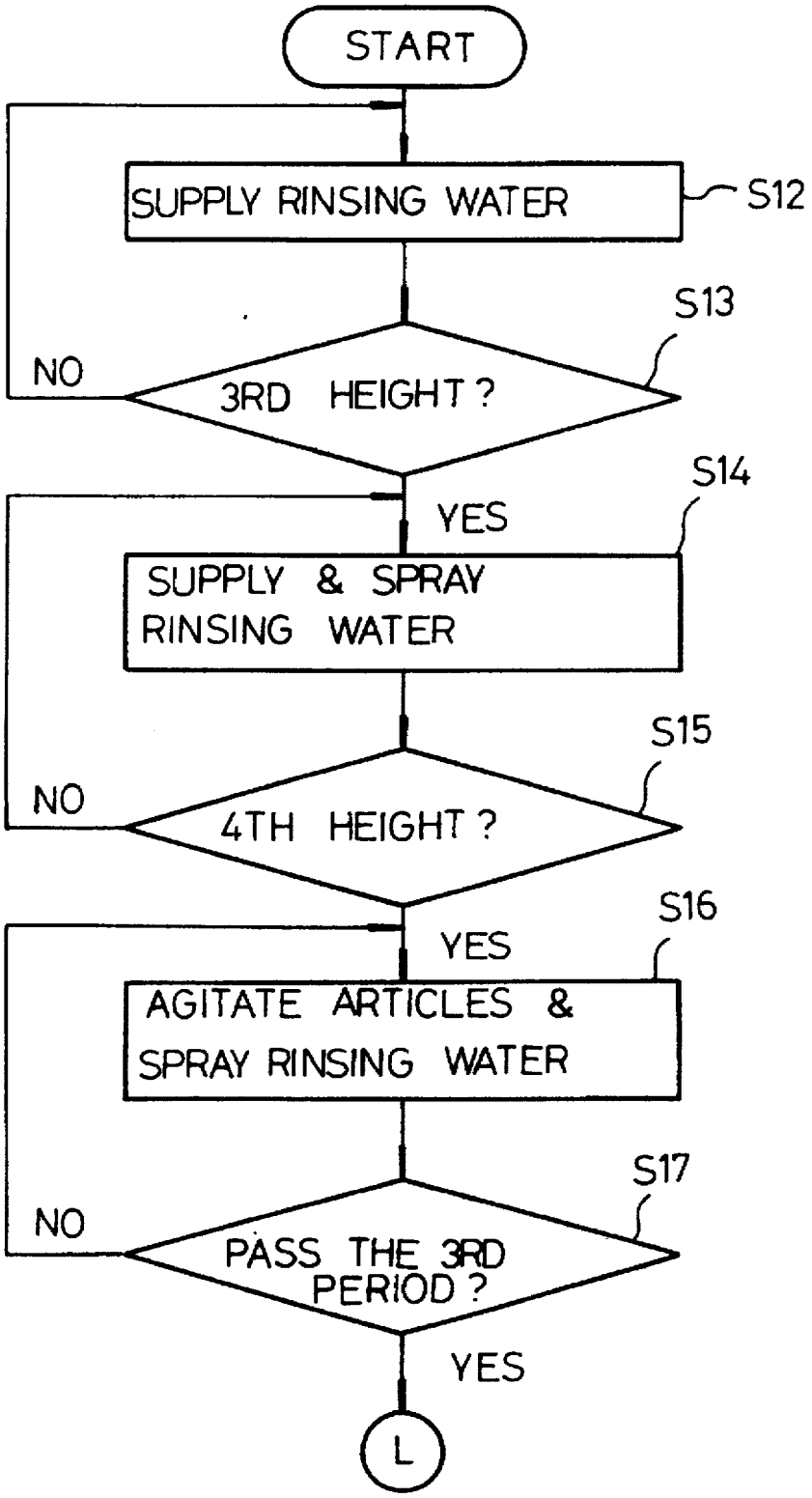
FIGS. 4A and 4B are a flow chart of a rinsing process according to the second embodiment of the present invention.
Figure 4B:
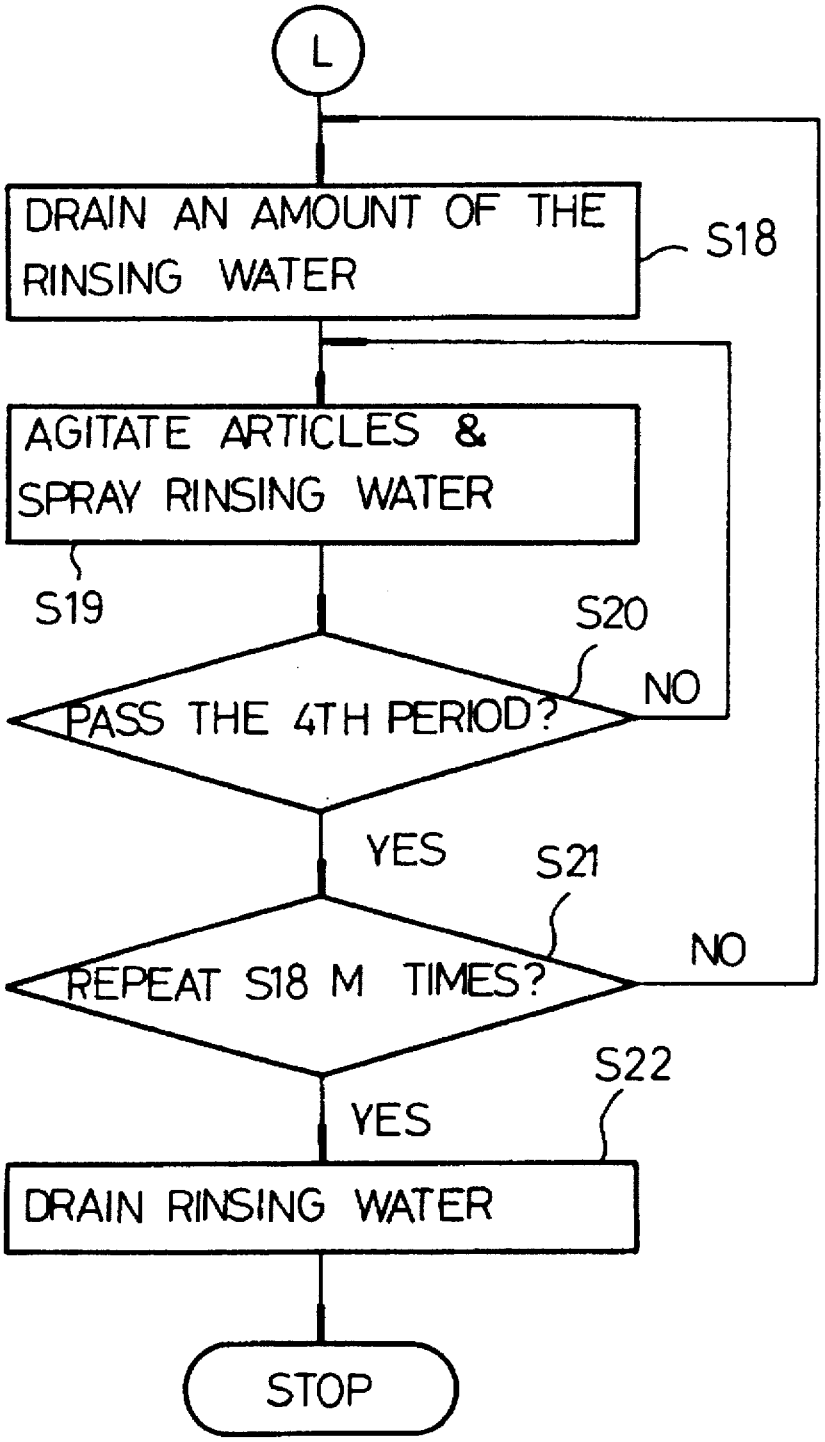

FIGS. 4A and 4B are a flow chart of the rinsing process. After the washing process as is in the first embodiment, rinsing water is introduced through water-supply pipe 111 into spin tub 104 by the operation of supply section 204 according to a signal from control signal input section 204 (step S12). In this case, the rinsing water may be fresh water with no additives.

The rinsing water continues to be supplied into spin tub 104 until its height reaches the predetermined third height in container 103. During the supply of the rinsing water, height-sensing section 203 senses the height of the rinsing water and sends it to microprocessor 201 as data. Microprocessor 201 compares the third height and the data with each other and determines if the height of the rinsing water in spin tub 104 and container 103 reaches the third height (step S13).

When the height of rinsing water reaches the third height, microprocessor 201 initiates the operation of recirculation-supply section 206. According to the operation of recirculation-supply section 206, valve 110 is opened, and pump 108 pumps out a part of the rinsing water in container 103 and spin tub 104 and supplies to spray nozzle 102 through recirculation pipe 109. The pumped rinsing water is sprayed through spray nozzle 102 into spin tub 104 (step S14). That is, a pan of the rinsing water in container 103 is recirculated and sprayed while the supply of the rinsing water into spin tub 104 continues, when the height of the rinsing water reaches the third height. In this case, such recirculation and spray of the rinsing water as above facilitates rapid dissolution of the detergent remaining in the washing load, spin tub 104, and container 103, washes away the remaining detergent therefrom, and thereby shortens the rinsing time.

Meanwhile, the rinsing water continues to be introduced and sprayed into spin tub 104 even after the height of the rinsing water reaches the third height. Height-sensing section 203 continues to sense the height of the rinsing water, and microprocessor 201 determines on the basis of data from height-sensing section 203 if the height of the rinsing water reaches the fourth height (step S15). In this case, the third and fourth heights are data preset in microprocessor 201 through control signal input section 202 according to the washing condition.

When the height of the rinsing water reaches the fourth height, microprocessor 201 stops the operation of supply section 204 and initiates the operation of driving section 205 so as to rotate pulsator 106 (step S16). Accordingly, the supply of the rinsing water is stopped, and the rinsing water in spin tub 104 is agitated by the rotation of pulsator 105. Even while pulsator 105 rotates, the operation of recirculation-spray section 206 continues, and thereby the rinsing water continues to be sprayed through spray nozzle 102 into spin tub 104. The spray of the rinsing water improves the rinsing effect of the washing machine.

While the rotation of pulsator 105 for rinsing is initiated at the fourth height in the present embodiment, the rotation may be initiated at the third height or at a proper height between the third and the fourth heights.

The fourth height is higher than the third height, and the difference between the first and fourth heights can be optimized by properly determining the third height according to the washing conditions.

After the rotation of pulsator 105 is started, microprocessor 201 determines if the third period has passed (step S17). The third period is preset in microprocessor 201 through control signal input section 202 by the user.

After the third period, microprocessor 201 stops the operation of driving section 205, thereby stopping the rotation of pulsator 105, and it operates drain section 207 so as to drain a predetermined amount of rinsing water out of washing machine 100 (step S18). Meanwhile, the rotation of pulsator 105 by the operation of driving section 205 may continue while the rinsing water is drained, according to other embodiments of the present invention.

When the predetermined rinsing water has been drained in step S18, the height of the rinsing water is lowered, and foam having been generated due to the remaining detergent and the agitation of the rinsing water by the rotation of pulsator 105 gathers on the lowered top of the rinsing water and in the gap between container 103 and spin tub 104. As described above, this foam not only weakens the rinsing force of the rinsing water but also may disturb the rotation of spin tub 104 in a dehydrating process due to the surface tension of the foam.

After the predetermined amount of the rinsing water is drained, microprocessor 201 operates driving section 205 and recirculation-supply section 206 again, so as to wash the washing load by rotating pulsator 105 and at the same time spray the rinsing water through the recirculation thereof (step S19). The above spray of the rinsing water removes the gathered foam and prevents production of new foam or suds.

While the washing load is rinsed and the rinsing water is sprayed in step S19, microprocessor 201 determines if the fourth period has passed (step S20). The fourth period is preset in microprocessor 201 through control signal input section 202 by a user.

After the fourth period, microprocessor 201 determines if step S18 in which the predetermined amount of the rinsing water is drained has been performed a preset m times (step S21). M times is a value preset in microprocessor 201 through control signal input section 202 by a user.

When step S18 has not been performed m times, the rinsing process goes back to step S18 and is repeated again from step S18. When step S18 has been performed m times, the rinsing process ends.

In this case, microprocessor 201 is programmed to make drain section 207 drain the rinsing water out of the container 103 completely. However, according to other embodiments, the rinsing process may further include step S22 of draining the rinsing water out of the washing machine in order to ensure the drainage of the rinsing water from the washing machine.

In the washing method of the present invention as described above, a part of the washing liquid is continuously recirculated and sprayed during the washing process while the washing liquid is partially drained at every predetermined time interval. Through the above recirculation and spray of the washing liquid with the divisional drainage thereof, the washing method of the present invention eliminates the foam formed during the washing process and prevents the formation of new foam.

Further, according to the second embodiment of the present invention, a part of the rinsing water is also continuously recirculated and sprayed during the rinsing process while the rinsing water is partially drained at each predetermined time interval. Through the above recirculation and spray of the rinsing water with the divisional drainage thereof in the rinsing process, the washing method of the present invention further eliminates the foam that has formed during the rinsing process and prevents the formation of new foam.

Further to the above advantageous effect, the washing method of the present invention improves the washing effect greatly, in that the spray and the divisional drainage of the washing liquid washes away undissolved detergent in the washing machine and cleans dirts such as foam or suds remaining at each stage during the washing and the rinsing processes.

Moreover, the washing method of the present invention largely reduces the amount of the rinsing water, thereby greatly improving rinsing effect, because the rinsing process starts in a state that the detergent foam has been completely removed.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A washing method by a washing machine having a spin tub for accommodating articles to be washed and a container for mounting the spin tub in the container, the spin tub having means for interconnecting a space in the container and a gap between the spin tub and the container, the washing method comprising the steps of:

(1) introducing a first amount of a washing liquid into the spin tub until a height of the washing liquid in the container reaches a first height;

(2) recirculating a first portion of the washing liquid in the container, and spraying the first portion of the washing liquid into the spin tub, while introducing a second amount of the washing liquid into the spin tub until the height of the washing liquid reaches a second height;

(3) washing the articles in the spin tub during a first period;

(4) draining a predetermined amount of the washing liquid in the container out of the washing machine;

(5) recirculating a second portion of the washing liquid remaining in the container, and spraying the second portion of the washing liquid into the spin tub, while washing the articles during a second period; and (6) repeating steps 4 and 5 at least once.

2. A washing method as claimed in claim 1, wherein the articles are washed in the spin tub in step 2.

3. A washing method as claimed in claim 1, wherein the second height is higher than the first height.

4. A washing method as claimed in claim 1, wherein the first portion of the washing liquid is recirculated and sprayed into the spin tub while the articles in the spin tub are washed in step 3.

5. A washing method as claimed in claim 4, wherein the spin tub has a peripheral wall, and the washing liquid is sprayed toward the peripheral wall in steps 2, 3 and 5.

6. A washing method as claimed in claim 1, wherein the articles in the spin tub are washed while the predetermined amount of the washing liquid in the container is drained out of the washing machine in step 4.

7. A washing method as claimed in claim 1, wherein the first and the second heights, and the first and the second periods are variably preset by a user according to a required washing condition.

8. A washing method as claimed in claim 1, wherein the predetermined amount of the washing liquid in step 4 is one-third of a quantity of the washing liquid in the container when the height of the washing liquid is the second height, and steps 4 and 5 are repeated three times in step 6.

9. A washing method as claimed in claim 1, said method further comprising the step of draining the washing liquid out of the container after step 6.

10. A washing method as claimed in claim 1, said method further comprising a rinsing process after step 6.

11. A washing method as claimed in claim 10, said rinsing process comprising the steps of:

(7) introducing a first amount of a rinsing water into the spin tub until a height of the rinsing water in the container reaches a third height;

(8) recirculating a first portion of the rinsing water in the container, and spraying the first portion of the rinsing water into the spin tub, while introducing a second amount of the rinsing water into the spin tub until the height of the rinsing water reaches a fourth height;

(9) agitating the articles in the rinsing water in the spin tub during a third period;

(10) draining a predetermined amount of the rinsing water in the container out of the washing machine;

(11) recirculating a second portion of the rinsing water remaining in the container, and spraying the second portion of the rinsing water into the spin tub, while agitating the articles in the rinsing water in the spin tub during a fourth period; and

(12) repeating steps 10 and 11 at least once.

12. A washing method as claimed in claim 11, wherein the articles are agitated in the rinsing water in the spin tub in step 8.

13. A washing method as claimed in claim 11, wherein the fourth height is higher than the third height.

14. A washing method as claimed in claim 11, wherein the first portion of the rinsing water is recirculated and sprayed while the articles are agitated in the rinsing water in the spin tub in step 9.

15. A washing method as claimed in claim 14, wherein the spin tub has a peripheral wall, and the rinsing water is sprayed toward the peripheral wall in steps 8, 9, and 10.

16. A washing method as claimed in claim 11, wherein the articles are agitated in the rinsing water in the spin tub while the predetermined amount of the rinsing water in the container is drained out of the washing machine in step 10.

17. A washing method as claimed in claim 11, wherein the third and the fourth heights, and the third and the fourth periods are variably preset by a user according to a required washing condition.

18. A washing method as claimed in claim 11, wherein the predetermined amount of the rinsing water in step 10 is one-third of a quantity of the rinsing water in the container when the height of the rinsing water is the fourth height, and steps 4 and 5 are repeated three times in step 12.

19. A washing method as claimed in claim 1, said method further comprising the step of draining the rinsing water out of the container after step 12.

20. A washing method by a washing machine having a spin tub for accommodating articles to be washed and a container for mounting the spin tub in the container, the spin tub having means for interconnecting a space in the container and a gap between the spin tub and the container, the method comprising the steps of:

(1) introducing a first amount of a washing liquid into the spin tub until a height of the washing liquid in the container reaches a first height;

(2) recirculating a first portion of the washing liquid in the container, and spraying the first portion of the washing liquid into the spin tub, while introducing a second amount of the washing liquid into the spin tub until the height of the washing liquid reaches a second height higher than the first height;

(3) washing the articles in the spin tub, while recirculating and spraying the first portion of the washing liquid during a first period;

(4) draining a predetermined amount of the washing liquid in the container out of the washing machine, while washing the articles in the spin tub, the predetermined amount being one-third of a quantity of the washing liquid in the container when the height of the washing liquid is the second height;

(5) recirculating a second portion of the washing liquid remaining in the container, and spraying the second portion of the washing liquid into the spin tub, while washing the articles during a second period;

(6) repeating steps 4 and 5 three times;

(7) introducing a first amount of a rinsing water into the spin tub until a height of the rinsing water in the container reaches a third height;

(8) recirculating a first portion of the rinsing water in the container, and spraying the first portion of the rinsing water into the spin tub, while introducing a second amount of the rinsing water into the spin tub until the height of the rinsing water reaches a fourth height higher than the third height;

(9) agitating the articles in the rinsing water in the spin tub, while recirculating and spraying the first portion of the rinsing water during a third period;

(10) draining a predetermined amount of the rinsing water in the container out of the washing machine, while agitating the articles in the rinsing water in the spin tub, the predetermined amount being one-third of a quantity of the rinsing water in the container when the height of the rinsing water is the fourth height;

(11) recirculating a second portion of the rinsing water remaining in the container, and spraying the second portion of the rinsing water into the spin tub, while agitating the articles in the rinsing water in the spin tub during a fourth period; and

(12) repeating steps 10 and 11 three times.

* * * * *